United States Patent [19]

Tai

[11] 3,932,056

[45] Jan. 13, 1976

[54] VANE DAMPING

[75] Inventor: Harold Tai, Riverside, Calif.

[73] Assignee: Barry Wright Corporation, Watertown, Mass.

[22] Filed: Dec. 9, 1974

[21] Appl. No.: 534,293

Related U.S. Application Data

[63] Continuation of Ser. No. 401,358, Sept. 27, 1973, abandoned.

[52] U.S. Cl. ..... 415/174; 415/191; 416/190

[51] Int. Cl.[2] ..... F01D 11/08; F01D 5/10

[58] Field of Search ..... 415/136, 137, 174, 191, 415/217, 219; 416/190, 500

[56] References Cited

UNITED STATES PATENTS

| | | | |
|---|---|---|---|
| 2,427,244 | 9/1947 | Warner | 415/217 |
| 2,952,442 | 9/1960 | Warnken | 415/174 |
| 2,997,275 | 8/1961 | Bean et al. | 415/217 |
| 3,556,675 | 1/1971 | Howald et al. | 416/190 |
| 3,778,184 | 12/1973 | Wood | 415/174 |

*Primary Examiner*—Carlton R. Croyle
*Assistant Examiner*—L. J. Casaregola
*Attorney, Agent, or Firm*—Milton E. Gilbert

[57] ABSTRACT

Damping of turbine or compressor vanes loosely supported in an outer shroud is accomplished by means of resilient metal damping pads which have slots to accommodate the outer ends of the vanes. The damping pads engage the opposite sides of the vanes and the slots are formed so as to provide gaps or relief areas between the pads and the side and end edges of the outer ends of the vanes.

9 Claims, 5 Drawing Figures

VANE DAMPING

This application is a continuation of my application Ser. No. 401,358 (now abandoned) filed Sept. 27, 1973 for Vane Damping.

This invention relates to turbines and compressors and more particularly to novel damping means for a vane assembly.

Much effort has been expended in developing improved vane assemblies for turbines and compressors, as exemplified in U.S. Pat. Nos. 3,071,346, 3,556,675, 3,095,138, 3,519,282 and 2,952,442. One particular problem has been to minimize vibration of vane assembly components.

The primary object of this invention is to provide a novel means for damping vane vibration in a gas turbine or compressor.

Another object is to provide an improved damping structure for a turbine or compressor vane assembly.

A further object and feature of this invention is to provide damping means for a vane assembly whereby the extent of damping can be controlled by controlling the density of the damping means.

Still another object is to provide an improved vane assembly wherein the individual vanes are damped against vibrations by damping elements made of a wire mesh fabric.

A more specific object is to provide damping means for turbine and compressor vanes which can be made and installed so as to have a predetermined damping characteristic, can be readily installed or removed without need for any special vane treatment, are not directly affixed to the vanes, do not radially preload the vanes, and are so designed as to withstand structural erosion by relative movement of the vanes.

Described briefly, in a vane assembly featuring the present invention, a plurality of vanes are disposed in a row between an inner shroud and an outer shroud, with each vane having one end affixed to the inner shroud and an opposite end that extends loosely through a slot in the outer shroud and is received in damping means in the form of a wire mesh pad of selected density. According to this invention, the wire mesh pad engages the opposite sides of the vane but is spaced from its side and end edges whereby to effectively vibration damp the vane and also to increase the service life of the pad. Each pad may engage one or more vanes.

Other features and advantages of the invention are disclosed or rendered obvious from the following detailed description and the accompanying drawings wherein.

The same numbers are used in the several figures to designate the same components or parts thereof.

Figure 1:
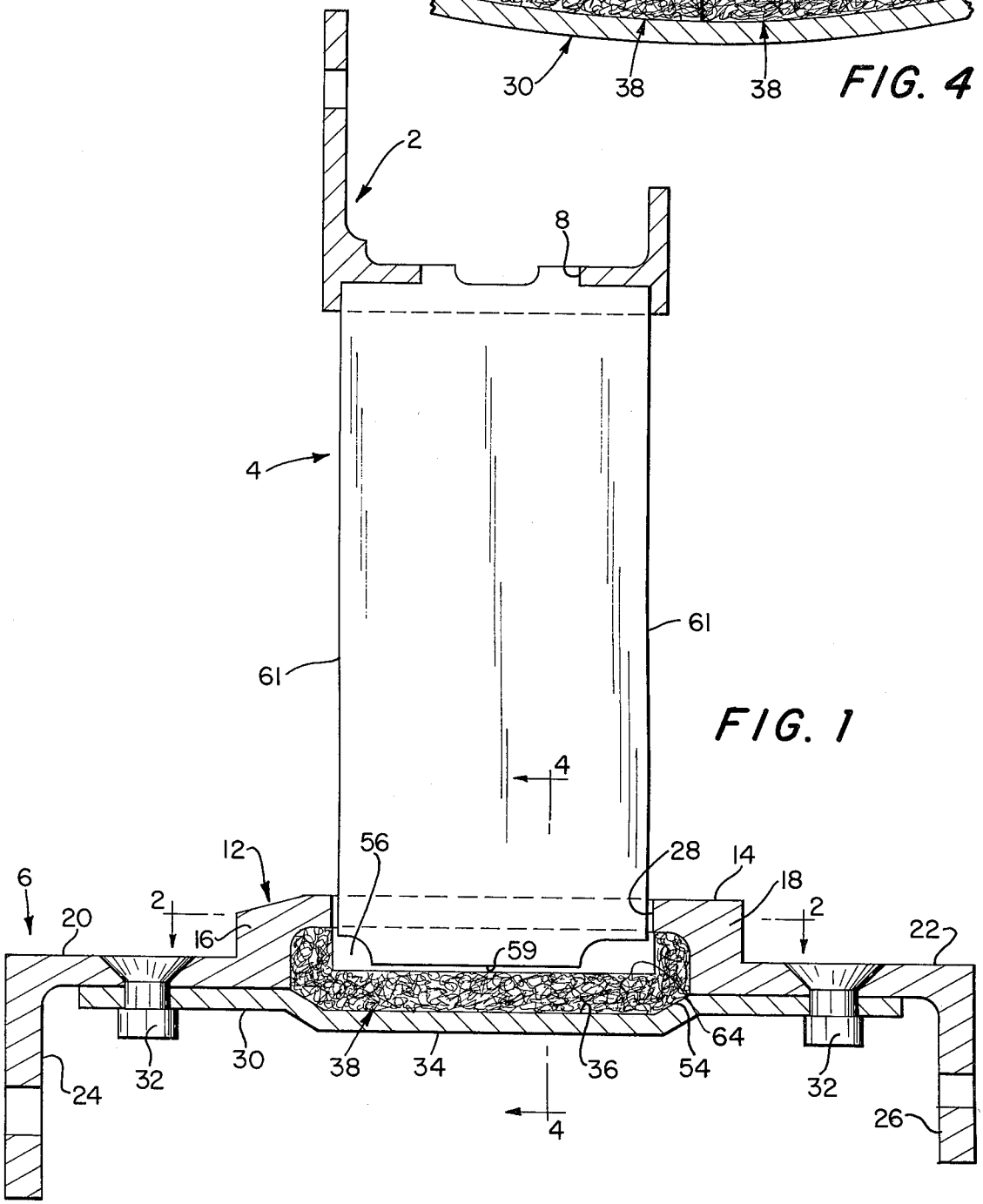
FIG. 1 is an axial sectional view through a vane assembly that constitutes and incorporates a preferred embodiment of the invention.

Referring now to FIG. 1, the illustrated vane assembly comprises an inner shroud ring 2, a row of circumferentially spaced vanes 4 (only one of which is shown), and an outer shroud ring 6. The inner shroud ring 2 has a plurality of circumferentially spaced slots 8 (only one of which is shown) for receiving the inner ends of the vanes. The vanes are secured in slots 8 by brazing, welding or other suitable means known to persons skilled in the art.

In cross-section, the outer shroud ring 6 is preferably shaped as shown in FIG. 1. More particularly, shroud ring 6 has a vane-retaining center section 12 that is U-shaped in cross-section and consists of a cylindrical wall 14 and annular radially extending walls 16 and 18. This center section 12 is preferably formed with axially projecting cylindrical flanges 20 and 22 that are formed with radially projecting annular flanges 24 and 26. The latter are adapted for attachment to suitable supporting structure, or to adjacent vane assemblies when forming part of a multi-stage compressor or turbine. The outer shroud ring 6 has a plurality of circumferentially spaced slots 28 (only one of which is shown) to accommodate the outer ends of the vanes as shown. Surrounding the outer shroud ring is a cover ring 30 which is preferably attached to cylindrical flanges 20 and 22 by rivets 32 as shown. Preferably, cover ring 30 is formed with a U-shaped center section 34 which cooperates with the U-shaped section 12 of the outer shroud ring to define a chamber 36 that extends for the full circumference of the outer shroud ring and serves to accommodate a plurality of damping pads 38 (see FIG. 4).

Damping pads 38 may be made of knitted, woven or braided wire mesh fabric or felt metal or steel wool and as such are porous and compressible. A preferred form of pad is one made from a stainless steel single filament knitted wire fabric which is rolled or folded into a bundle and the bundle compressed. The wire may be of any springy metal but a stainless steel wire of suitable spring characteristic is preferred since it is resistant to rust and corrosion. On compressing the bundle, sufficient pressure is applied to overcome the elastic limit of the wire at many points within the bundle to form a pad or cushion of desired firmness, i.e. stiffness. In the compressed body of the pad or cushion, there is a very large number of points of contact of the wire with itself and there will similarly be a relatively large number of short spans of the wire between the points of contact. As a result, the compressed body is still springy. The pad's ability to undergo deflection and recovery under changing compression loadings over a wide range of loads may be limited to such an extent as is needed for the particular application, and can be controlled by appropriate selection of the wire material and the degree to which the fabric is compressed. In other words, the density of the pad, i.e. the extent to which the bundle of wire mesh fabric is compressed, determines the effectiveness of the damping action of the pad on the end of the vane with which it is associated. The art of forming cushions from a wire mesh fabric for vibration damping applications is well known, as exemplified by U.S. Pat. Nos. 3,073,557, 3,250,502, 3,346,302, 2,680,284, 2,869,858 and 2,426,316. A pad formed of compressed steel wool or felt metal also may function effectively with the damping action being related to its density. Regardless of whether they are made of a wire mesh fabric, felt metal, steel wool, or other wire material, the damping pads may be formed to any appropriate shape using suitable forming dies. For the purposes of this invention, the pads are formed to a selected shape and size appropriate to the specific turbine assembly in which they are to be incorporated. Also, as noted below, a separate damping pad may be provided for each vane or each pad may be adapted to accommodate two or more vane ends.

Figure 2:
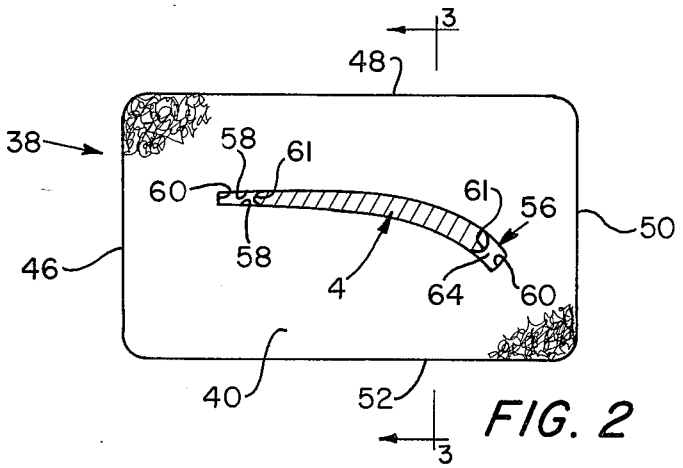
FIG. 2 is a sectional view taken along line 2—2 of FIG. 1.
Figure 3:
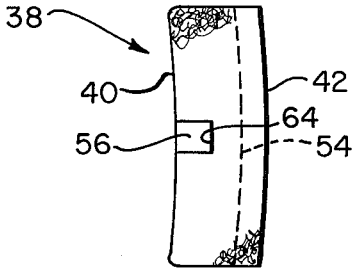
FIG. 3 is a sectional view taken along line 3—3 of FIG. 2.

Referring now to FIGS. 1–4, in the preferred embodiment of the invention a separate damping pad 38 is employed for each vane. In this case, each pad 38 is formed with a rectangular configuration and top and bottom surfaces 40 and 42 that are curved along their shorter dimension (see FIGS. 3 and 4) and flat along their longer dimension (FIG. 1). Preferably the four sides 46, 48, 50 and 52 are bevelled at the bottom of the pad as shown at 54 in FIGS. 1 and 3 so as to facilitate proper nesting of the pads in the chamber 36 formed between the outer shroud ring and cone ring 30. Preferably also the upper edges of sides 46–52 and the four corners of each pad are rounded off as shown in FIGS. 2 and 3 so as to reduce the likelihood of damaging the pads by rough handling. Additionally, each pad is formed with a slot or cavity 56 in its proper concave surface 40 to receive the outer end of a vane. As seen in FIG. 2, the slot 56 is curved in conformity with the cross-sectional shape of the outer end of the associated vane; preferably the side walls 58 and the end walls 60 of the slot extend at substantially a right angle to the pad's upper surface 40.

Figure 4:
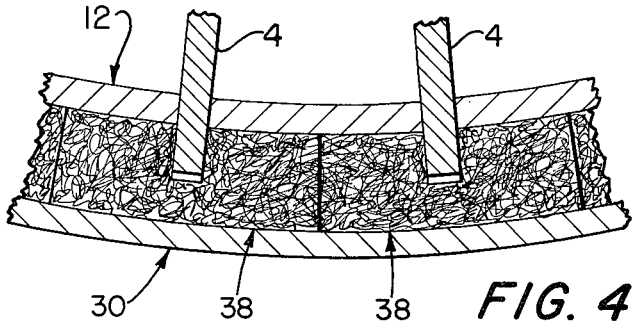
FIG. 4 is a fragmentary sectional view taken along line 4—4 of FIG. 1.

In order to achieve effective vibration damping of the vanes, it is essential that the vanes be engaged by the associated damping pads. However, the damping pads can be damaged by abrasion and if such deterioration occurs it will materially shorten the service life of the pads. In this connection it is to be noted that the end edges 59 of the vanes and also their leading and trailing edges, i.e. their side edges 61, present sharp sections of solid material which could cut and tear the metal mesh material of the pads under dynamic load conditions. Accordingly each slot 56 is formed so that the spacing between its two side walls 58 is the same or slightly less than the thickness of the inserted vane. Additionally each slot 56 is formed and dimensioned so that (a) the distance between its end walls 60 is substantially in excess of the corresponding dimension of the associated vane as shown in FIGS. 1 and 2, and (b) its depth is sufficient to permit a gap to exist between its bottom wall 64 and the end edge 59 of the associated vane when installed as shown in FIG. 1. As a consequence and because the pads are resilient, the side walls 58 of a given slot 56 are forced apart slightly when the end of a vane is inserted in the slot and the spring characteristic of the pad urges the side walls to return to their as-formed position so that they pinch and exert a gripping force on the outer end of the vane, whereby the pad can dampen vane vibration. Because of the engagement of the concave and convex side walls 58 of the pad slot with the opposite sides of the vane, the outer end of the vane is restrained against movement in a direction along the circumference of the outer shroud ring and also to a lesser degree in a direction along the chord of the vane. Additionally the relief areas provided between the end walls and bottom wall of the slot and the side edges and bottom edge of the inserted vane prevent or at least substantially minimize cutting and tearing of the metal mesh pad. The relief or gap between the end edge of the vane and the bottom wall of the pad slot avoids radial pre-loading of the pad by the vane and permits more freedom of relative movement. The width and breadth of each pad is such that slot 56 is spaced far enough from the sides 48-52 of the pad to allow sufficient pad material for damping the inserted vane and for engaging the U-shaped center section 12 of the outer shroud ring as shown in FIG. 1. The thickness of the pads is preferably set so that a predetermined degree of pre-loading, i.e., pad compression, occurs in the regions engaged between shroud ring 6 and cover ring 30 when the pads are captivated in chamber 36. The pads are arranged side by side as shown in FIG. 4 so as to extend along the full circumference of chamber 36. The curvatures of the upper and lower surfaces 40 and 42 facilitate disposition of the pads, maximize the degree of engagement between the pads and the shroud and cover rings, and minimize distortion of the pads under the retaining force exerted by cover ring 30.

It also is contemplated to have each pad serve as a vibration damping means for more than one vane. However, because of the close spacing of the vanes and their cross-sectional shapes, it has been found advantageous to form the pads in a diamond or parallelogram shape. This modification is shown in FIG. 5.

Figure 5:
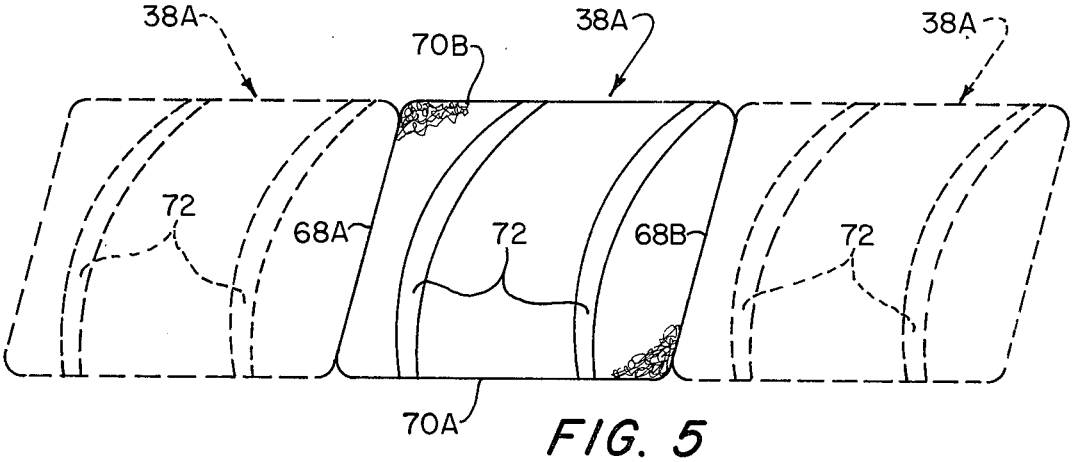
FIG. 5 is a plan view showing several damping pads constituting a modification of the invention.

Referring now to FIG. 5, a series of vibration damping pads 38A are provided which are made of the same material and in the same manner as pads 38 of FIGS. 1–4. In this case, however, each pad is preferably formed in a diamond shape with parallel opposite end walls 68A and 68B, and parallel opposite side walls 70A and 70B. Side wall 70A extends at an angle of about 75° to end wall 68A. Also each pad is formed with two slots 72 which may be made like slot 56. Preferably, however, slots 72 do not terminate in end walls like end walls 60 of slot 56, but instead extend fully from one to the other of side walls 70 so that their ends are open, as shown in FIG. 5. Open ended slots 72 are easier to form than slot 56 and the absence of end walls 60 eliminates one possible region of pad wear.

The diamond shape shown in FIG. 5 has been found advantageous in assuring adequate pad material for vibration damping on each side of the chord of each vane. It is to be noted that the typical turbine vane is curved in cross-section so as to have a shape similar to the vane cross-section shown in FIG. 2, and the chord of the vane is a straight line connecting the centers of the opposite side edges of the vane. Depending upon its size, a square or rectangular damping pad having two or more vane slots may not provide enough material along opposite sides of each vane to provide adequate damping. This problem is avoided by employing pads of parallelogram shape as shown in FIG. 5. In this case the slots 72 are oriented so that the chord line of the inserted vane extends generally parallel to the ends 68A and B. As a result, more pad material is available on each side of each slot for damping purposes than would be the case with a rectangular pad having ends and sides of the same length as ends and sides 68A, B and 70A, B. In other words, as between a rectangular pad and a parallelogram pad having equal areas and an equal number of like vane-receiving slots, more damping material is available on each side of each slot in the parallelogram-shaped pad.

As previously noted the pads may be made with selected densities and stiffness. Preferably the pads are made so that they are stressed or compressed under dynamic loading to only about 10% of their capacity.

In summary the invention has the following advantages. First of all the damping pads have a long service life due to the relief areas provided at the side and end edges of the inserted vane which materially reduce deterioration by abrasive wear. Secondly the pads can be made of metals that are highly resistant to temperature. Thirdly the damping pads exert no radial pressure on the ends of the cones. Fourthly each pad may be designed to provide damping for more than one vane. Fifthly the pads allow freedom of movement of the vanes in selected directions to allow for expansion and contraction under temperature changes. Sixthly the diamond shaped pads assure adequate damping material support for each vane on each side thereof. Seventhly, no particular preparation is required for the outer end of the vane since the associated damping pad is not attached to the vane positively in any way. Eighthly, by controlling the density of the damping pad when it is made, it is possible to establish a predetermined pad stiffness and thereby achieve an effective and predictable damping action on the vane. Also since when a vane vibrates the vibration-energy is dissipated internally within the associated damping pad, the invention requires no structural restraint on the outer end of the vane with respect to the outer shroud and serves to reduce vibratory stress levels. Still other advantages will be obvious to persons skilled in the art.

It is appreciated that the invention is susceptible of modifications. Thus, for example, three or more slots may be provided in each pad to accommodate the outer ends of a like number of vanes. Still other modifications will be obvious to persons skilled in the art.

What is claimed is:

1. A turbine vane or compressor assembly including:

a plurality of turbine vanes arranged about an axis with each vane extending in a generally radial direction relative to said axis, each of said vanes having an inner end and an outer end;

an inner shroud to which the inner ends of the vanes are secured;

an outer shroud having openings therein through which the outer ends of the vanes project;

a plurality of compressible pads made of metal wire surrounding the outer shroud, each of said pads comprising at least one slot in one surface thereof with the outer end of one of said vanes extending into said slot; and means surrounding and secured to said outer shroud for holding said pads in position relative to said outer shroud;

said slots being shaped and sized so that the opposite sides of each outer vane end is engaged by said pad and the side edges and the end edge of each outer vane end are in non-engaging relation with said pad.

2. Apparatus according to claim 1 wherein each pad is made of a plurality of layers of a wire mesh fabric which are mechanically interlocked to form a porous compressible mass.

3. Apparatus according to claim 1 wherein each pad is made up of a number of layers of a wire mesh fabric which have been mechanically interlocked by compressive deformation.

4. Apparatus according to claim 1 wherein said vanes are curved in cross-section, and said slots have a corresponding longitudinal configuration.

5. Apparatus according to claim 1 wherein the length of said slots exceeds the width of said vanes.

6. Apparatus according to claim 5 wherein said slots extend from one edge to the other of said pads.

7. Apparatus according to claim 1 wherein each pad comprises at least two slots with an outer end of a vane extending into each of said slots.

8. Apparatus according to claim 1 wherein said pads have a rectangular configuration.

9. Apparatus according to claim 1 wherein said pads have a parallelogram configuration.

* * * * *

UNITED STATES PATENT OFFICE

CERTIFICATE OF CORRECTION

PATENT NO. : 3,932,056

DATED : January 13, 1976

INVENTOR(S) : Harold Tai

It is certified that error appears in the above-identified patent and that said Letters Patent are hereby corrected as shown below:

Column 3, line 20 - Delete word "proper" and substitute therefor the word "upper"

Column 5, line 30 - Insert after word "turbine" the words "or compressor" and delete after the word "vane" the words "or compressor"

Signed and Sealed this

*eleventh* Day of *May 1976*

[SEAL]

*Attest:*

RUTH C. MASON
*Attesting Officer*

C. MARSHALL DANN
*Commissioner of Patents and Trademarks*